US007748967B2

(12) United States Patent
Park et al.

(10) Patent No.: US 7,748,967 B2
(45) Date of Patent: Jul. 6, 2010

(54) LINEAR COMPRESSOR

(75) Inventors: Kyeong Bae Park, Seoul (KR); Ki Chul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 11/558,985

(22) Filed: Nov. 13, 2006

(65) Prior Publication Data

US 2007/0134116 A1 Jun. 14, 2007

(30) Foreign Application Priority Data

Nov. 10, 2005 (KR) ..... 10-2005-0107698

(51) Int. Cl.
*F04B 39/10* (2006.01)
*F04B 53/12* (2006.01)

(52) U.S. Cl. ..... 417/545; 417/552; 417/417; 137/856

(58) Field of Classification Search ..... 417/547, 417/545, 552, 555.1, 417, 902; 137/856
See application file for complete search history.

(56) References Cited

U.S. PATENT DOCUMENTS 2,811,226 A * 10/1957 Allinquant ..... 188/317
3,831,626 A * 8/1974 Peddinghaus ..... 137/493.8
5,016,669 A * 5/1991 Jamieson ..... 137/512
5,370,504 A 12/1994 Nagashima
6,299,423 B1 * 10/2001 Perevozchikov ..... 418/55.1
6,914,353 B2 7/2005 Hong et al.
6,917,127 B2 7/2005 Hong et al.
7,063,520 B2 * 6/2006 Oh et al. ..... 417/547
2003/0206817 A1 * 11/2003 Oh et al. ..... 417/417
2004/0047751 A1 3/2004 Kim et al.
2004/0228746 A1 * 11/2004 Noh et al. ..... 417/417

(Continued)

FOREIGN PATENT DOCUMENTS

JP 57-184284 A 11/1982

(Continued)

OTHER PUBLICATIONS

U.S. Appl. No. 11/565,008 to Lee et al., which was filed on Nov. 30, 2006.

(Continued)

*Primary Examiner*—Devon C Kramer
*Assistant Examiner*—Peter J Bertheaud
(74) *Attorney, Agent, or Firm*—Birch, Stewart, Kolasch & Birch, LLP

(57) ABSTRACT

Disclosed herein is a linear compressor in which a piston reciprocally moves in a cylinder upon receiving a reciprocating drive force of a linear motor to compress working-fluid, for example, refrigerant, received in the cylinder. The linear compressor comprises the piston adapted to reciprocally move in the cylinder, the piston being internally formed with a suction path, a suction valve to open or close the suction path of the piston to selectively connect the suction path of the piston to the interior of the cylinder, and a suction valve stopper to limit the degree of opening of the suction valve, whereby no excessive stress is applied to the suction valve. This has the effect of eliminating damage and deformation of the suction valve, minimizing vibration and noise due to the opening/closing operations of the suction valve, and maintaining the compression efficiency of the compressor at a constant value.

8 Claims, 5 Drawing Sheets

U.S. PATENT DOCUMENTS

| | | | |
|---|---|---|---|
| 2004/0247457 | A1 | 12/2004 | Kim et al. |
| 2004/0247466 | A1 | 12/2004 | Lee et al. |
| 2005/0053471 | A1 | 3/2005 | Hong et al. |
| 2005/0184687 | A1 | 8/2005 | Hong et al. |
| 2006/0091735 | A1 | 5/2006 | Song et al. |

FOREIGN PATENT DOCUMENTS

| | | | |
|---|---|---|---|
| JP | 2002-54570 | A | 2/2002 |
| KR | 10-2002 0043273 | | 6/2002 |
| KR | 10-2003 0090010 | | 11/2003 |
| KR | 10-2004 0012217 | | 2/2004 |

OTHER PUBLICATIONS

U.S. Appl. No. 11/565,018 to Park et al., which was filed on Nov. 30, 2006.
U.S. Appl. No. 11/470,005 to Park et al., which was filed on Sep. 5, 2006.
U.S. Appl. No. 11/470,271 to Park et al., which was filed on Sep. 6, 2006.
English language abstract of KR 10-2004-0012217.
English language abstract of KR 10-2003-0090010.
English language abstract of KR 10-2002-0043273.

* cited by examiner

LINEAR COMPRESSOR

BACKGROUND OF THE INVENTION

1. Field of the Invention

The present invention relates to a linear compressor, and more particularly, to a linear compressor including a suction valve stopper, which limits the degree of opening of a suction valve when the suction valve performs an opening operation.

2. Description of the Related Art

Generally, a linear compressor is an apparatus configured in such a fashion that a piston reciprocates in a cylinder upon receiving a reciprocating drive force of a linear motor to compress working-fluid, for example, refrigerant, received in the cylinder. The linear compressor is mainly used in refrigerators, etc.

FIG. 1 is a sectional view illustrating a conventional linear compressor. FIG. 2 is a view of important parts of the conventional linear compressor, illustrating the advance movement of a piston. FIG. 3 is a view of important parts of the conventional linear compressor, illustrating the retraction movement of the piston.

As shown in FIGS. 1 to 3, the conventional linear compressor comprises a shell 2 forming the outer appearance of the compressor, a cylinder block 4 and a back cover 6 which are arranged in the shell 2, and a compression unit provided between the cylinder block 4 and the back cover 6. The compression unit serves to compress working-fluid by a desired compression ratio.

The shell 2 is provided with a fluid suction pipe 8 and a fluid discharge pipe 9, such that the working-fluid to be compressed is sucked into the compression unit from the outside of the shell 2, and then, is again discharged out of the shell 2 after being compressed in the compression unit.

The compression unit includes a cylinder 10 into which the working-fluid, having passed through the fluid suction pipe 8, is sucked, a piston 20 to compress the working-fluid sucked into the cylinder 10 while performing reciprocating movements in the cylinder 10, and a linear motor 30 to reciprocally move the piston 20.

The cylinder 10 is provided with a discharge valve assembly 12, such that the working-fluid, compressed in the cylinder 10, is discharged into the fluid discharge pipe 9 in accordance with the operation of the discharge valve assembly 12.

The piston 20 is internally formed with a suction path 21 for allowing the working-fluid, having passed through the fluid suction pipe 8, to be sucked into the cylinder 10. Also, the piston 20 has a suction valve 22 to open or close the suction path 21.

The suction valve 22 is an elastic member fastened to the piston 20 by means of a bolt B. The suction valve 22 is designed to be opened or closed as it is elastically deformed in accordance with a pressure difference between the suction path 21 of the piston 20 and the interior of the cylinder 10.

The linear motor 30 basically includes a stator 32, and a mover 34. The mover 34 is adapted to reciprocally move while electromagnetically interacting with the stator 32. The mover 34 is connected to the piston 20.

The compression unit further includes a main spring assembly 40 for providing the piston 20 with an elastic force in a reciprocating movement direction of the piston 20. Thus, the main spring assembly 40 allows vibrations of the piston 20 to some extent when the piston 20 reciprocally moves.

The main spring assembly 40 consists of a first main spring 42 located between the back cover 6 and the piston 20, and a second main spring 44 located between the cylinder 10 and the linear motor 30 to be supported by the cylinder block 4 and the piston 20.

The operation of the conventional linear compressor having the above-described configuration will now be explained.

If the linear motor 30 is driven, the piston 20 reciprocally moves in the cylinder 10 upon receiving the drive force of the linear motor 30. Then, the first and second main springs 42 and 44 are repeatedly compressed and tensioned in accordance with the reciprocating movements of the piston 20, thereby serving to allow vibrations of the piston 20 to some extent while causing the discharge valve assembly 12 and the suction valve 22 to be repeatedly opened or closed.

Thereby, the working-fluid is sucked into the cylinder 10 through the fluid suction pipe 8, such that it is compressed to a high-pressure state by the piston 20 in the cylinder 10. Subsequently, the compressed working-fluid is discharged from the cylinder 10 through the discharge valve assembly 12, to be discharged out of the shell 2 through the fluid discharge pipe 9.

The suction, compression, and discharge operations of the working fluid as stated above are continuously repeated in this sequence so long as the linear motor 30 is driven.

A problem of the above-described conventional linear compressor is that the suction valve 22 may be excessively opened due to a large pressure difference between the suction path 21 of the piston 20 and the interior of the cylinder 10, as shown in FIG. 3. This causes an increased stress to be applied to the suction valve 22, and therefore, there is a risk of plastic deformation or damage to the suction valve 22.

When the suction valve 22 exhibits such an excessively large degree of opening, an increased shock must be applied to the piston 20 when the suction valve 22 is closed, resulting in an increase in vibration and noise.

The degree of opening of the suction valve 22 may be changed in accordance with a pressure difference between the suction path 21 of the piston 20 and the interior of the cylinder 10. Therefore, an uneven amount of the working-fluid is sucked into the cylinder, making it impossible to achieve improved constant compression efficiency.

In particular, recently, environment-friendly nitrogen dioxide refrigerant has been widely used as the working fluid. However, when working-fluid is nitrogen dioxide refrigerant, the working-fluid exhibits a relatively high working pressure, causing more severe stress to be applied to the suction valve 22.

SUMMARY OF THE INVENTION

Therefore, the present invention has been made in view of the above problems, and it is an object of the present invention to provide a linear compressor including a suction valve stopper, which can limit the degree of opening of a suction valve when the suction valve 84 performs an opening operation, whereby there is no risk of deformation and damage to the suction valve due to the excessive opening of the suction valve, little vibration and noise are generated upon the opening/closing operations of the suction valve, and the compression efficiency of the linear compressor can be maintained at a constant value.

In accordance with one aspect of the present invention, the above and other objects can be accomplished by the provision of a linear compressor comprising: a piston adapted to reciprocally move in a cylinder, the piston being internally formed with a suction path; a suction valve to perform opening/closing operations, to allow the suction path of the piston to be selectively connected to the interior of the cylinder; and a suction valve stopper to limit the degree of opening of the suction valve.

Preferably, the suction valve stopper may be coupled to the piston.

Preferably, a portion of the suction valve stopper, which acts to limit the degree of opening of the suction valve, may have a tapered structure.

Preferably, a portion of the suction valve stopper, which acts to limit the degree of opening of the suction valve, may have a curved surface so come into surface con-act with the suction valve.

Preferably, the suction valve stopper may be formed with a stopper coupling hole such that a coupling member, which is used to couple the suction valve stopper to the piston, is embedded in she suction valve stopper.

Preferably, the suction valve stopper may have a flat outer surface at an opposite side of the suction valve.

Preferably, the suction valve stopper may take the form of a disk, a circumferential edge of the disk being partially cut away.

In accordance with another aspect of the present invention, the above and other objects can be accomplished by the provision of a linear compressor comprising: a piston adapted to reciprocally move in a cylinder, the piston being internally formed with a suction path; a suction valve to perform opening/closing operations, to allow the suction path of the piston to be selectively connected to the interior of the cylinder; and a suction valve stopper including: a stopper supporting portion configured to continuously come into contact with the suction valve; and a stopper limit portion configured to come into contact with the suction valve when the suction valve is opened to limit the degree of opening of the suction valve.

Preferably, the stopper limit portion may have a tapered structure.

Preferably, the stopper limit portion may be tapered away from the stopper supporting portion to be gradually distant from a front end surface of the piston.

In the linear compressor according to the present invention, the suction valve is inserted in the piston to selectively connect the suction path of the piston to a compression chamber of the cylinder, and the suction valve stopper is provided to limit the degree of opening of the suction valve, whereby no excessive stress is applied to the suction valve. As a result, the linear compressor of the present invention has the effects of preventing deformation and damage to the suction valve, minimizing vibration and noise due to the opening/closing operations of the suction valve, and maintaining the compression efficiency of the compressor at a constant value.

Further, the suction valve stopper of the present invention is configured to have a flat outer surface at an opposite of the suction valve, whereby working-fluid can be evenly compressed in the compression chamber of the cylinder in spite of the existence of the suction valve stopper.

Furthermore, the suction valve stopper of the present invention is configured to have a curved inner surface, such that the curved inner surfaces wholly comes into surface contact with the suction valve to limit the degree of opening of the suction valve, whereby more minimized stress is applied to the suction valve when the suction valve is opened, and the dead volume of the cylinder can be minimized.

The suction valve stopper is coupled to the piston to work in conjunction with the piston by use of a coupling member, which is also used to couple the suction valve to the piston. Thus, the suction valve stopper can achieve a simplified structure.

Also, the suction valve stopper is configured such that the coupling member is embedded in the suction valve stopper, resulting in a reduction in dead volume.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention wall be explained with reference to the accompanying drawings.

Figure 1:
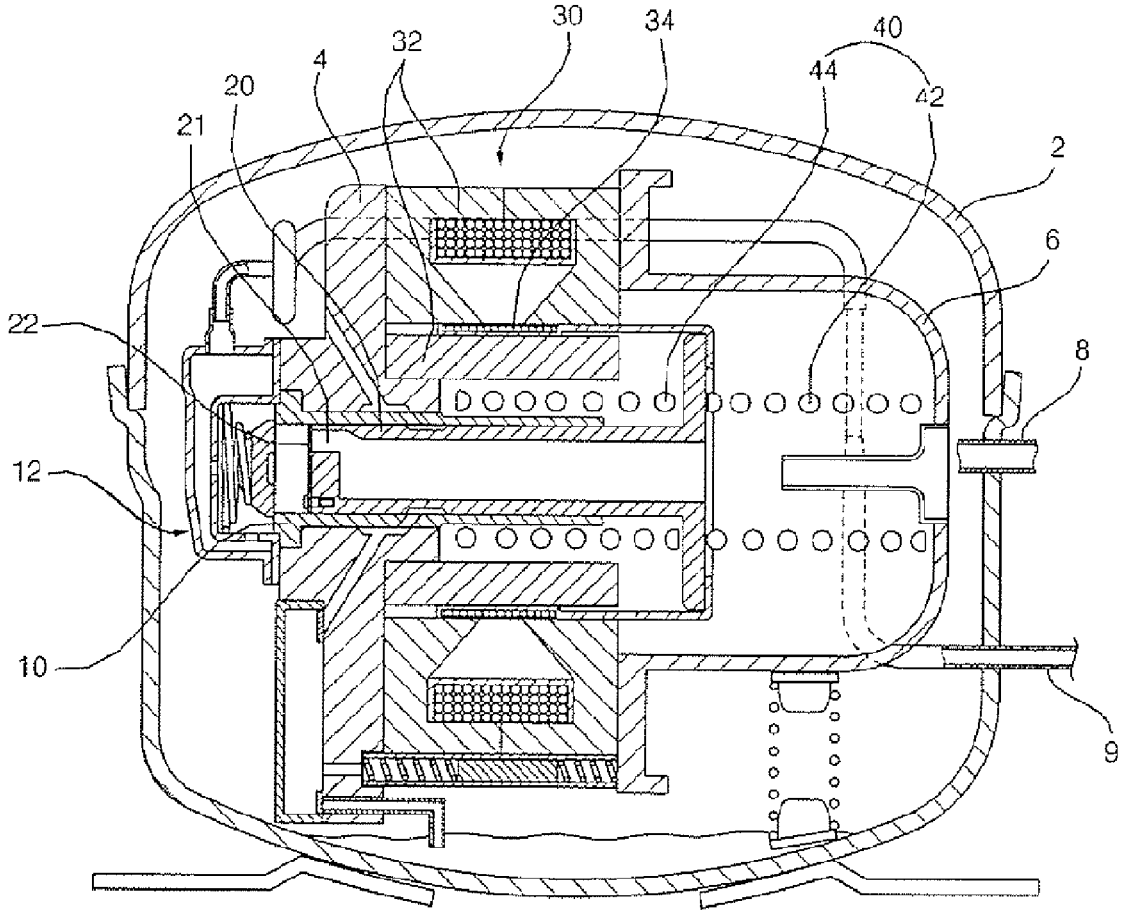
Fig. 1 (related art)
FIG. 1 is a sectional view illustrating a conventional linear compressor.
Figure 2:
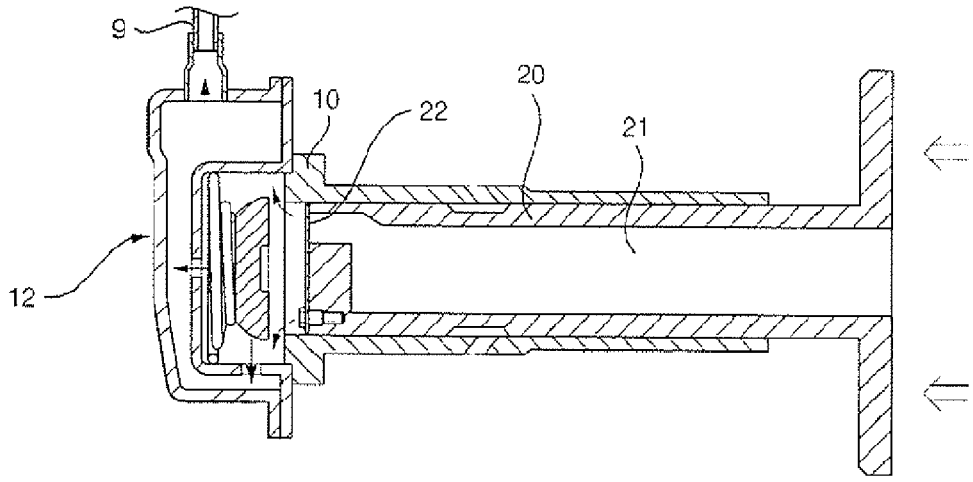
Fig. 2 (related art)
FIG. 2 is a view of important parts of the conventional linear compressor, illustrating the advance movement of a piston.
Figure 3:
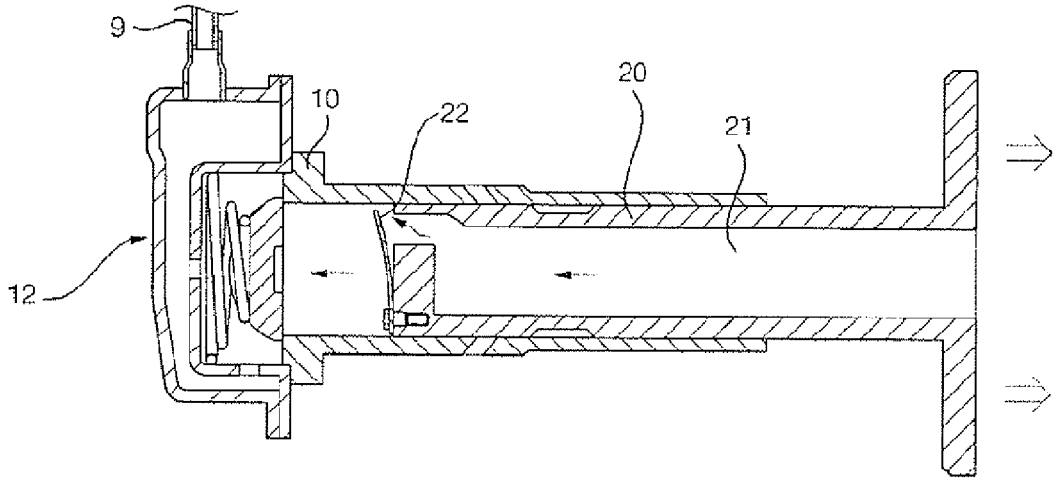
Fig. 3 (related art)
FIG. 3 is a view of important parts of the conventional linear compressor, illustrating the retraction movement of the piston.
Figure 4:
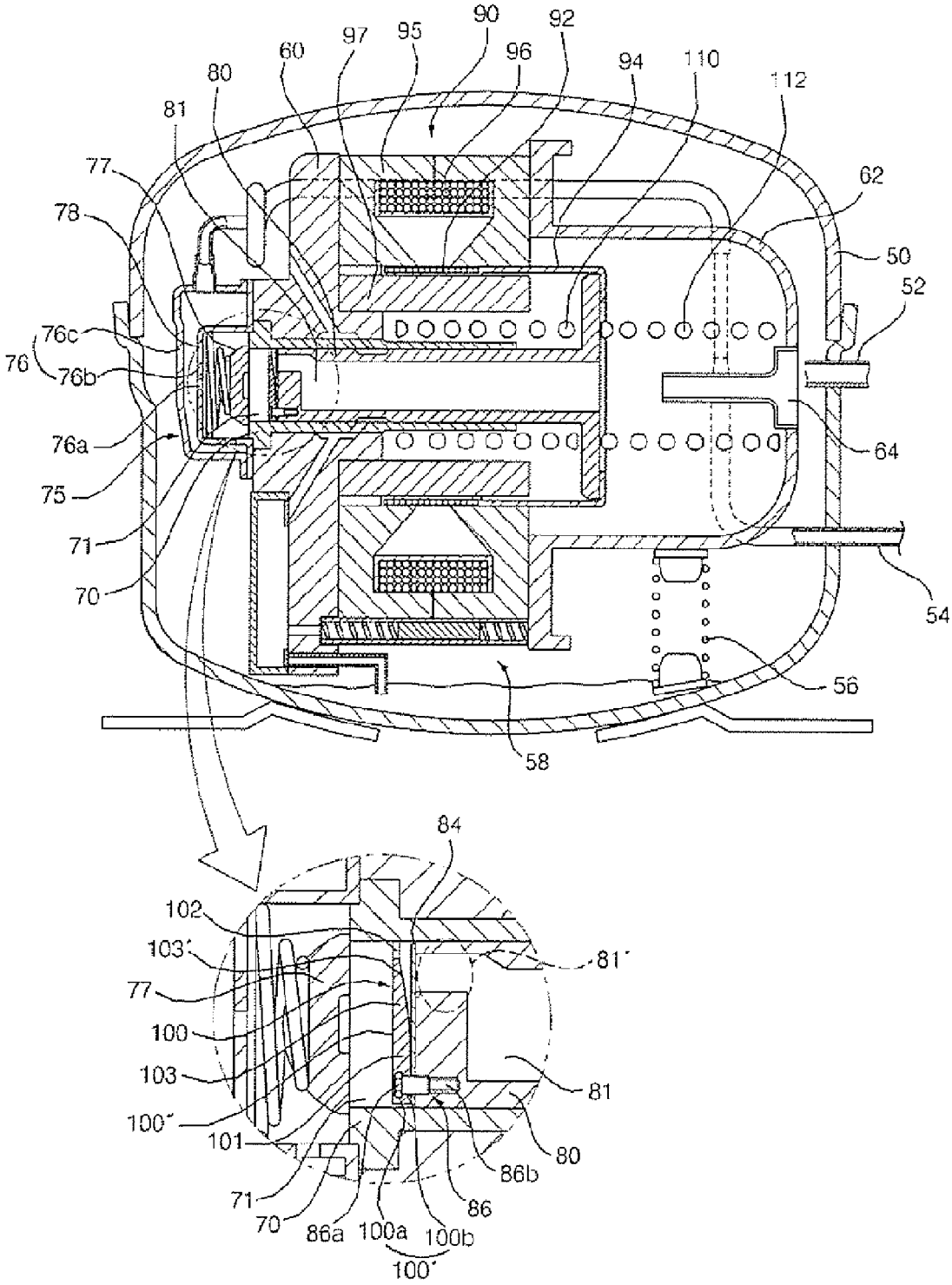
FIG. 4 is a sectional view illustrating a linear compressor according to the present invention.
Figure 5:
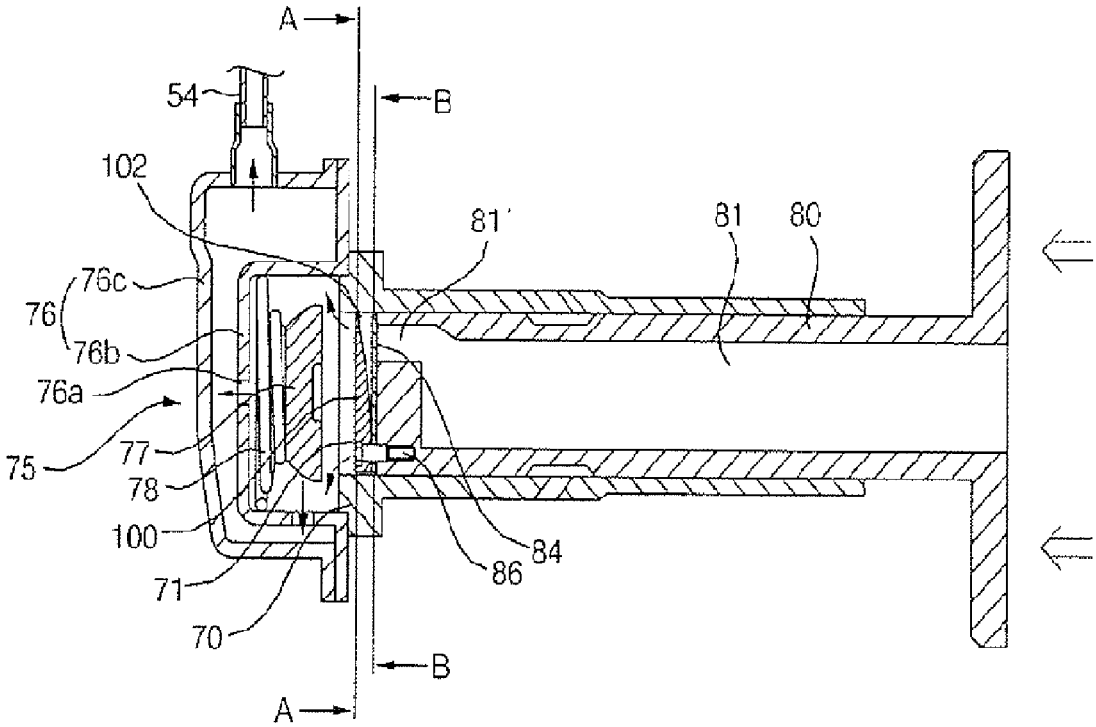
FIG. 5 is a view of important parts of the linear compressor according to the present invention, illustrating the advance movement of a piston.
Figure 6:
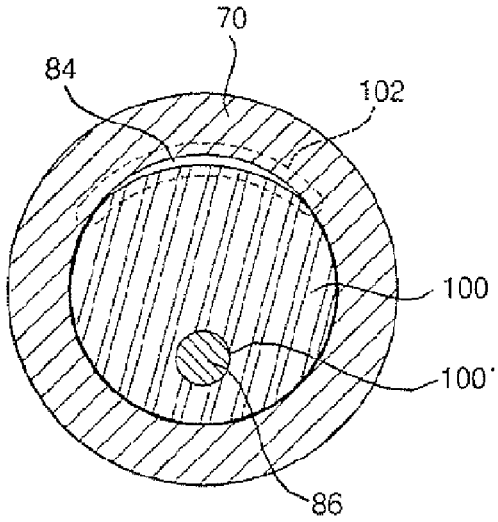
FIG. 6 is a sectional view taken along the line A-A of FIG. 5.
Figure 7:
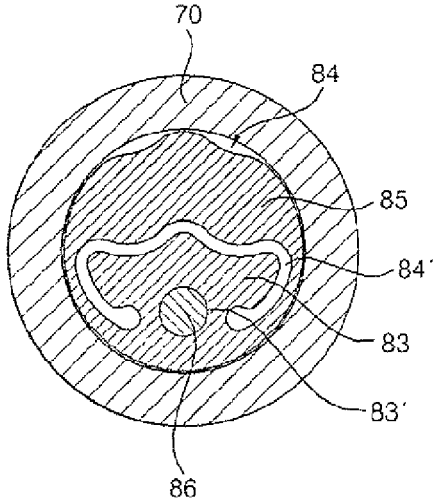
FIG. 7 is a sectional view taken along the line B-B of FIG. 5.
Figure 8:
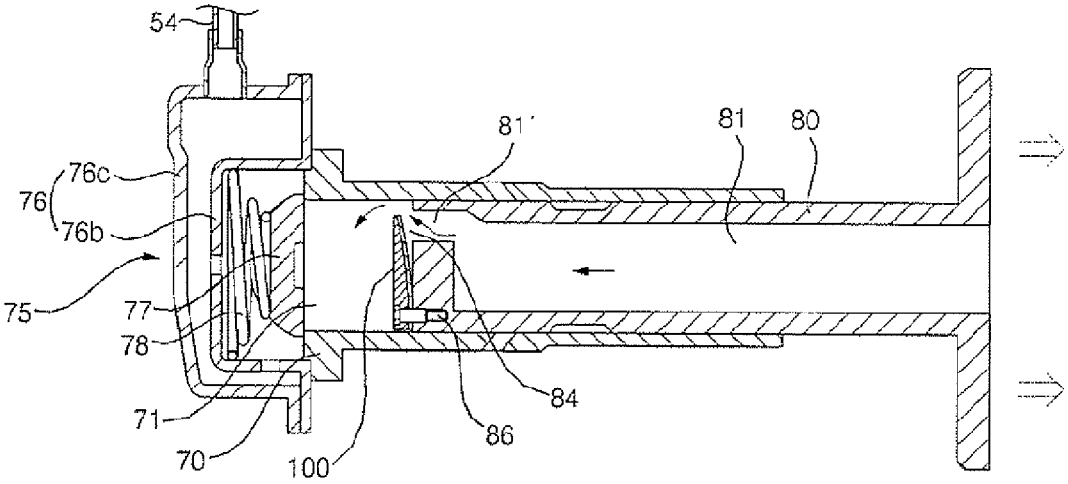
FIG. 8 is a view of important parts of the linear compressor according to the present invention, illustrating the retraction movement of the piston.

FIG. 4 is a sectional view illustrating a linear compressor according to the present invention. FIG. 5 is a view of important parts of the linear compressor according to the present invention, illustrating the advance movement of a piston. FIG. 6 is a sectional view taken along the line A-A of FIG. 5. FIG. 7 is a sectional view taken along the line B-B of FIG. 5. FIG. 8 is a view of important parts of the linear compressor according to the present invention, illustrating the retraction movement of the piston.

As shown in FIGS. 4 to 8, the linear compressor according to the present invention comprises a shell 50 configured to allow introduction and discharge of working fluid, a cylinder block 60 and a back cover 62 arranged in the shell 50, and a compression unit P provided between the cylinder block 60 and the back cover 62. The working-fluid, introduced into the shell 50, is compressed by a desired compression ratio while passing through the compression unit P, thereby being discharged in a high-pressure state.

A fluid suction pipe 52 is connected to the shell 50 such that the working-fluid is sucked into the shell 50 from an external station. Also, a fluid discharge pipe 54 is connected to the shell 50 such that the compressed working-fluid, discharged from the compression unit P, is guided out of the shell 50.

A damper 56 is mounted in the shell 50 to elastically support the compression unit P.

A lubricating oil pumping device 58 is arranged in the shell 50 to pump lubricating oil G in the bottom of the shell 50 to the compression unit P.

The back cover 62 is located closer to the fluid suction pipe 52 than the cylinder block 60.

A muffler 64 is mounted to the back cover 62 to reduce the noise of the working-fluid generated when the working-fluid passes through the fluid suction pipe 52.

The compression unit P includes a linear motor 90 to generate a reciprocating drive force, a cylinder 70 fixedly mounted to the cylinder block 60, the cylinder 70 internally defining a compression chamber 71 for the compression of the working-fluid, a piston 80 which performs reciprocating movements in the cylinder 70 using the reciprocating drive force of the linear motor 90 to compress the working-fluid received in the compression chamber 71 of the cylinder 70, and first and second resonance springs 110 and 112 to allow vibrations of the piston 80 to some extent in a reciprocating movement direction of the piston 80 when the piston 80 reciprocally moves.

The linear motor 90 is located around the cylinder 70, and is supported by the cylinder block 60 and the back cover 62.

Considering the configuration of the linear motor 90, it basically consists of a mover connected to the piston 80 to work in conjunction with the piston 80, and a stator adapted to electromagnetically interact with the mover for inducing reciprocating movements of the mover.

The mover includes a magnet 92 arranged inside the stator in a reciprocally movable manner, and a magnet frame 94 for the fixation of the magnet 92, the magnet frame 94 being connected to the piston 80 to work in conjunction with the piston 80. The magnet frame 94 serves to transmit the reciprocating drive force of the linear motor 90 to the piston 80.

The stator includes an outer core 95 located on the outer circumference of the mover, a coil 96 provided in the outer core 95 to generate a magnetic field, and an inner core 97 located on the inner circumference of the mover.

The cylinder 70 has a cylindrical structure having open front and rear ends. The piston 80 is inserted into the open rear end of the cylinder 70. After being compressed in the compression chamber 71 of the cylinder 70, the working-fluid is discharged from the open front end of the cylinder 70.

The open front end of the cylinder 70 is covered with the discharge valve assembly 75, such that the working-fluid, compressed in the compression chamber 71 of the cylinder 70, is discharged into the fluid discharge pipe 54.

The discharge valve assembly 75 includes a valve cover 76 mounted to cover the open front end of the cylinder 70 while being connected to the fluid discharge pipe 54, a discharge valve body 77 mounted to reciprocally move in front of the open front end of the cylinder 70 within the discharge valve cover 76, and a discharge valve spring 78 to elastically support the discharge valve body 77.

The discharge valve cover 76 may have a dual structure. Specifically, the discharge valve cover 76 includes an inner cover **76*b* having a discharge hole 76*a* for the discharge of the working-fluid, and an outer cover 76*c* located at the outside of the inner cover 76*b* to surround the inner cover 76*b*, the outer cover 76*c* being connected to the fluid discharge pipe 54**.

A suction path 81 is formed in the piston 80 to extend longitudinally throughout the interior of the piston 80, such that the suction path 81 is connected to both the fluid suction pipe 52 and the compression chamber 71 of the cylinder 70.

The suction path 81 of the piston 80 has a narrowed front end portion, which has a diameter smaller than that of the remaining portion of the suction path 81, to from a suction port 81'.

The suction path 81 of the piston 80 is designed to be selectively connected to the compression chamber 71 of the cylinder 70 by the suction valve 84, which performs opening/closing operations in accordance with the reciprocating movements of the piston 80.

The suction valve 84 is configured to open or close the suction path 81 of the piston 80 as it is elastically deformed in accordance with a pressure difference between the suction path 81 of the piston 80 and the compression chamber 71 of the cylinder 70 in a state wherein one surface of the suction valve 84 is fixed to a front end surface of the piston 80.

The suction valve 84 includes a fixed suction valve portion 83 fixed to the front end surface of the piston 80, and a movable suction valve portion 85 connected to the fixed suction valve portion 83, the movable suction valve portion 85 being elastically deformable to perform opening/closing operations. The suction valve 84 takes the form of an elastic plate having approximately the same size as that of the front end surface of the piston 80. An incised line 84' is formed along part of a boundary between the fixed suction valve portion 83 and the movable suction valve portion 85, to enable the elastic deformation of the movable suction valve portion 85.

The fixed suction valve portion 83 is perforated with a suction valve coupling hole 83' for the insertion of a coupling member 86, for example a bolt, such that the suction valve 84 is fixed to the front end surface of the piston 84 by means of the coupling member 86.

The suction valve coupling hole 83' of the fixed suction valve portion 83 is eccentric from the center of the suction valve 84.

Also, the suction valve coupling hole 83' of the fixed suction valve portion 83 is located opposite to the suction port 81' of the piston 80 about the center of the suction valve 84.

In the present invention, a suction valve stopper 100 is provided in front of the suction valve 84. The suction valve stopper 100 serves to limit the degree of opening of the suction valve 84 when the suction valve 94 opens the suction path 81 of the piston 80.

The suction valve stopper 100 includes a stopper supporting portion 101 configured to continuously come into contact with the suction valve 84, and a stopper limit portion 103 configured to come into contact with the suction valve 84 when the suction valve 84 is opened, in order to limit the degree of opening of the suction valve 84.

The stopper supporting portion 101 of the suction valve stopper 100 is coupled to the piston 80 such that the suction valve stopper 100 works in conjunction with the piston 80.

For the sake of a simplified general structure, the stopper supporting portion 101 of the suction valve stopper 100 may be coupled to the piston 80 by means of the coupling member 86 that is used to couple the suction valve 84 to the piston 80.

For this, the stopper supporting portion 101 of the suction valve stopper 100 is formed with a stopper coupling hole 100', such that the stopper coupling hole 100' is aligned with the suction valve coupling hole 83' of the suction valve 84, for allowing the coupling member 86 to be coupled through both the holes 100' and 83'.

In particular, it is preferable that the stopper coupling hole 100' of the suction valve stopper 100 be configured to allow the coupling member 86 to be embedded in the suction valve stopper 100, in order to minimize the dead volume of the compression chamber 71 of the cylinder 70.

Accordingly, the stopper coupling hole 100' of the suction valve stopper 100 has an expanded front portion **100*a*, such that a head 86*a* of the coupling member 86 is inserted into the expanded front portion 100*a*. The remaining rear portion 100*b* of the stopper coupling hole 100' is sized such that a stud 86*b* of the coupling member 86, having a diameter smaller than the head 86*a* of the coupling member 86, is inserted through the portion 100*b***.

In consideration of the fact that the suction valve 84 is opened as it bends about the coupling member 86, the stopper limit portion 103 of the suction valve stopper 100 is configured such that it is tapered away from the stopper supporting portion 101 of the suction valve stopper 100 to be gradually distant from the front end surface of the piston 80.

In particular, the stopper limit portion 103 of the suction valve stopper 100 may have a curved inner surface 103', which comes into surface contact with the movable suction valve portion 85 of the suction valve 84 when the suction valve 84 is opened.

The suction valve stopper 100 may take the form of a plate, which is formed with a working-fluid passage hole 102, and is sized to cover approximately the overall suction valve 84.

Specifically, the suction valve stopper 100 may be a disk, which has approximately the same diameter as the piston 80, but the circumferential edge of the disk is partially cut away to allow the passage of working-fluid.

The working-fluid passage hole 102 of the suction valve stopper 100 is preferably located at the same side as the suction port 81' of the piston 30 based on the center of the suction valve 84.

Also, the suction valve stopper 100 preferably has a flat outer surface 100" at an opposite side of the suction valve 84, to allow the working-fluid in the compression chamber 71 of the cylinder 70 to be evenly compressed.

Hereinafter, the operation of the linear compressor according to the present invention having the above-described configuration will be explained.

If the linear motor 90 is driven, the magnet 92 reciprocally moves along with the magnet frame 94 via the electromagnetic interaction of both the stator and the mover. The resulting reciprocating drive force of the linear motor 90 is transmitted to the piston 80 that is connected to the magnet frame 94. Thereby, the piston 80 reciprocally moves in the cylinder 70 upon receiving the drive force of the linear motor 90. Simultaneously, the first and second main springs 110 and 112 are repeatedly compressed and tensioned, causing the suction, compression, discharge of the working-fluid to be repeated in this sequence.

Specifically, as shown in FIGS. 5 and 7, if the piston 80 advances toward the interior of the cylinder 70, the suction valve 84 closes the suction path 1 of the piston 80 by a pressure difference between the suction path 81 of the piston 80 and the cylinder 70. Thus, the working-fluid in the compression chamber 71 of the cylinder 70 is compressed to a high-pressure state as the piston 80 moves into the cylinder 70.

Then, the discharge valve body 77 opens the compression chamber 71 of the cylinder 70 in accordance with the force equilibrium relationship between the pressure of the working-fluid in the compression chamber 71 of the cylinder 70 and the discharge valve spring 78.

Thereby, the working-fluid, compressed in the compression chamber 71 of the cylinder 70, is discharged out of the shell 50 via the discharge cover 76 and the fluid discharge pipe 54 in this sequence.

Conversely, as shown in FIG. 8, if the piston 80 retracts out of the cylinder 70, the movable suction valve portion 85 of the suction valve 84 bends toward the compression chamber 71 of the cylinder 70 about the coupling member 86 by a pressure difference between the suction path 81 of the piston 80 and the compression chamber 71 of the cylinder 70, thereby opening the suction path 81 of the piston 80. Also, the discharge valve assembly 75 closes the compression chamber 71 of the cylinder 70 in accordance with the force equilibrium relationship between she interior pressure of the cylinder 70 and the discharge valve spring 78.

Thereby, the working-fluid is sucked into the compression chamber 71 of the cylinder 70 by passing through the fluid suction pipe 52, the muffler 64, and the suction path 81 of the piston 80 in this sequence.

In this case, the suction valve 84 is opened to an appropriate degree in accordance with the operation of the suction valve stopper 100, and therefore, no excessive stress is applied to the suction valve 84. Also, even when the opened suction valve 84 is closed, no shock is applied to the piston 80 and the suction valve 84, and an even amount of working-fluid can be sucked into the compression chamber 71 of the cylinder 70.

For reference, although the dead volume of the cylinder 70 inevitably increases due to the existence of the suction valve stopper 100 as compared to the prior art, the suction valve stopper 100 of the present invention is configured to minimize the increase of the dead volume. When working-fluid having a high operating pressure, for example carbon dioxide refrigerant, is used, or a difference between the suction pressure and discharge pressure of working-fluid is large, the increased dead volume is negligible. Thus, it can be said that the suction valve stopper 100 has little effect on the performance of the compressor.

As is apparent from the above description, the present invention provides a linear compressor having the following several advantages.

Firstly, the linear compressor according to the present invention is configured such that a suction valve is inserted in a piston to selectively connect a suction path of the piston to a compression chamber of a cylinder, and a suction valve stopper is provided to limit the degree of opening of the suction valve, whereby no excessive stress is applied to the suction valve. As a result, the linear compressor of the present invention has the effects of preventing deformation and damage to the suction valve, minimizing vibration and noise due to the opening/closing operations of the suction valve, and maintaining the compression efficiency of the compressor at a constant value.

Secondly, the suction valve stopper of the present invention is configured to have a flat outer surface at an opposite of the suction valve, whereby working-fluid can be evenly compressed in the compression chamber of the cylinder in spite of the existence of the suction valve stopper.

Thirdly, the suction valve stopper of the present invention is configured to have a curved inner surface, such that the curved inner surfaces wholly comes into surface contact with the suction valve to limit the degree of opening of the suction valve, whereby more minimized stress is applied to the suction valve when the suction valve is opened, and the dead volume of the cylinder can be minimized.

Fourthly, according to the present invention, the suction valve stopper is coupled to the piston to work in conjunction with the piston by use of a coupling member, which is also used to couple the suction valve to the piston. Thus, the suction valve stopper can achieve a simplified structure.

Fifthly, the suction valve stopper is configured such that the coupling member is embedded in the suction valve stopper, resulting in a reduction in dead volume.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A linear compressor comprising:

a piston reciprocally movable within a cylinder, the piston being internally formed with a suction path;

a suction valve to perform opening/closing operations, to allow the suction path of the piston to be selectively connected to the interior of the cylinder; and a suction valve stopper to limit the degree of opening of the suction valve, wherein the suction valve is deformable such that an upper surface of the suction valve engages a lower surface of the suction valve stopper when the suction valve is opened, wherein the lower surface of the suction valve stopper, which acts to limit the degree of opening of the suction valve, has a curved surface to come into surface contact with the suction valve, wherein the suction valve stopper has a flat upper surface opposite the lower surface, wherein the suction valve stopper is coupled to the piston, the suction valve stopper comprising a disk having a diameter substantially equal to a diameter of the piston, and wherein a circumferential edge of the disk is partially cut away to form a passage for a working fluid.

2. The compressor as set forth in claim 1, wherein the suction valve stopper is formed with a stopper coupling hole such that a coupling member, which is used to couple the suction valve stopper to the piston, is embedded in the suction valve stopper.

3. The compressor as set forth in claim 1, wherein the suction valve stopper is eccentrically coupled to the piston.

4. A linear compressor comprising:

a piston reciprocally movable within a cylinder, the piston being internally formed with a suction path;

a suction valve to perform opening/closing operations to allow the suction path of the piston to be selectively connected to the interior of the cylinder;

a suction valve stopper including: a stopper supporting portion configured to continuously come into contact with the suction valve; and a stopper limit portion configured to come into contact with the suction valve when the suction valve is opened to limit the degree of opening of the suction valve, wherein the suction valve is deformable such that an upper surface of the suction valve engages a lower surface of the suction valve stopper when the suction valve is opened, wherein a lower surface of the suction valve stopper, which acts to limit the degree of opening of the suction valve, has a curved surface to come into surface contact with the suction valve, wherein the suction valve stopper has a flat upper surface opposite the lower surface, wherein the suction valve stopper is coupled to the piston, the suction valve stopper comprising a disk having a diameter substantially equal to a diameter of the piston, and wherein a circumferential edge of the disk is partially cut away to form a passage for a working fluid.

5. The compressor as set forth in claim 4, wherein the suction valve stopper is formed with a stopper coupling hole such that a coupling member, which is used to couple she suction valve stopper to the piston, is embedded in the suction valve stopper.

6. The compressor as set forth in claim 4, wherein the suction valve stopper is eccentrically coupled to the piston.

7. A linear compressor comprising:

a piston reciprocally movable within a cylinder, the piston being internally formed with a suction path;

a suction valve to perform opening/closing operations, to allow the suction path of the piston to be selectively connected to the interior of the cylinder; and a disk shaped suction valve stopper configured to come into contact with the suction valve as the suction valve bents to be opened, thereby serving to limit the degree of opening of the suction valve, wherein the suction valve is deformable such that an upper surface of the suction valve engages a lower surface of the suction valve stopper when the suction valve is opened, wherein the lower surface of the suction valve stopper, which acts to limit the degree of opening of the suction valve, has a curved surface to come into surface contact with the suction valve, wherein the suction valve stopper has a flat upper surface opposite the lower surface, wherein the suction valve stopper is eccentrically coupled to the piston at a first location, the suction valve stopper comprising a disk having a diameter substantially equal to a diameter of the piston, and wherein a portion of a circumferential edge of the disk opposite the first location is partially cut away to form a passage for a working fluid.

8. The compressor as set forth in claim 7, wherein the suction valve stopper is formed with a stopper coupling hole such that a coupling member, which is used to couple the suction valve stopper to the piston, is embedded in the suction valve stopper.

* * * * *